US007095303B2

(12) United States Patent
Ohkubo et al.

(10) Patent No.: US 7,095,303 B2
(45) Date of Patent: Aug. 22, 2006

(54) ELECTROMAGNETIC CONTACTOR

(75) Inventors: Koji Ohkubo, Tokyo (JP); Hidekazu Miyazawa, Tokyo (JP); Hidehiko Ogawa, Tokyo (JP)

(73) Assignee: Fuji Electric FA Components & Systems Co., Ltd, Tokyo (JP)

( * ) Notice: Subject to any disclaimer, the term of this patent is extended or adjusted under 35 U.S.C. 154(b) by 0 days.

(21) Appl. No.: 10/536,754

(22) PCT Filed: Sep. 19, 2003

(86) PCT No.: PCT/JP03/12009

§ 371 (c)(1),
(2), (4) Date: Oct. 17, 2005

(87) PCT Pub. No.: WO2004/049368

PCT Pub. Date: Jun. 10, 2004

(65) Prior Publication Data

US 2006/0125581 A1 Jun. 15, 2006

(30) Foreign Application Priority Data

Nov. 27, 2002 (JP) ..... 2002-343939

(51) Int. Cl.
*H01H 67/02* (2006.01)

(52) U.S. Cl. ..... 335/132; 335/202

(58) Field of Classification Search ..... 335/132, 335/202

See application file for complete search history.

(56) References Cited

U.S. PATENT DOCUMENTS 6,297,717 B1 * 10/2001 Heckenkamp ..... 335/132
6,377,143 B1 * 4/2002 Zhou et al. ..... 335/132

FOREIGN PATENT DOCUMENTS

| | | |
|---|---|---|
| FR | 2 560 429 | 8/1985 |
| JP | 64-16043 | 1/1989 |
| JP | 02-119024 | 5/1990 |
| JP | 02-150631 | 12/1990 |
| JP | 3-58844 | 6/1991 |
| JP | 05-094754 | 4/1993 |
| JP | 07006680 | 1/1995 |
| JP | 5-21290 | 3/2003 |

* cited by examiner

*Primary Examiner*—Lincoln Donovan
(74) *Attorney, Agent, or Firm*—Rabin & Berdo, P.C.

(57) ABSTRACT

A mold frame is formed with two collision sections opposed to a back face of a movable iron core with a movable contact support therebetween. One collision section is higher than the other. The movable contact support includes an inclined plane on the base bottom face thereof and near the higher collision section. The base bottom face abuts the back face of the movable core. When this contactor is attached with the higher collision section provided at the lower side, the support having collided in the "released" condition is rotated around the collision section, thereby reducing the impact. When this contactor is attached with the lower section at the lower side, the support attracted toward the core by a plate spring is allowed to collide, at the bounce of the support, with the back face of the core via the inclined plane, thereby canceling the inertia by the bounce.

1 Claim, 4 Drawing Sheets

Fig. 3
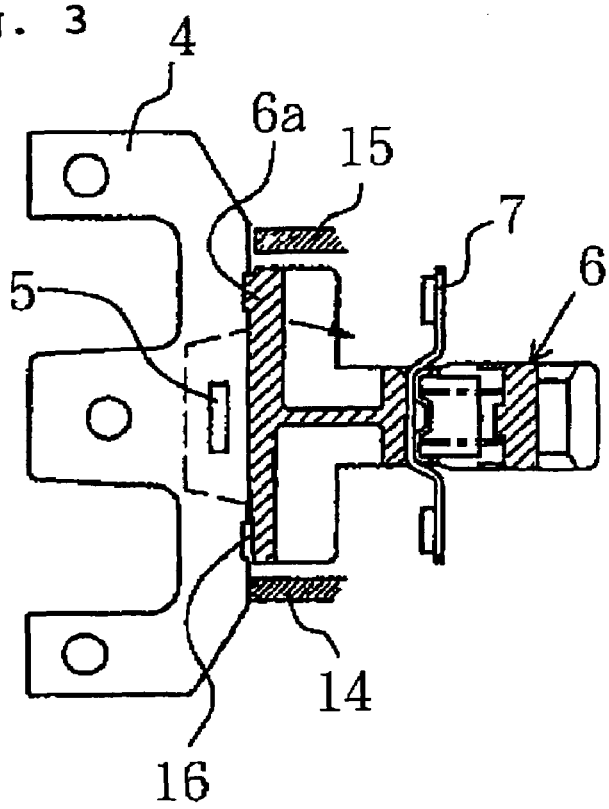
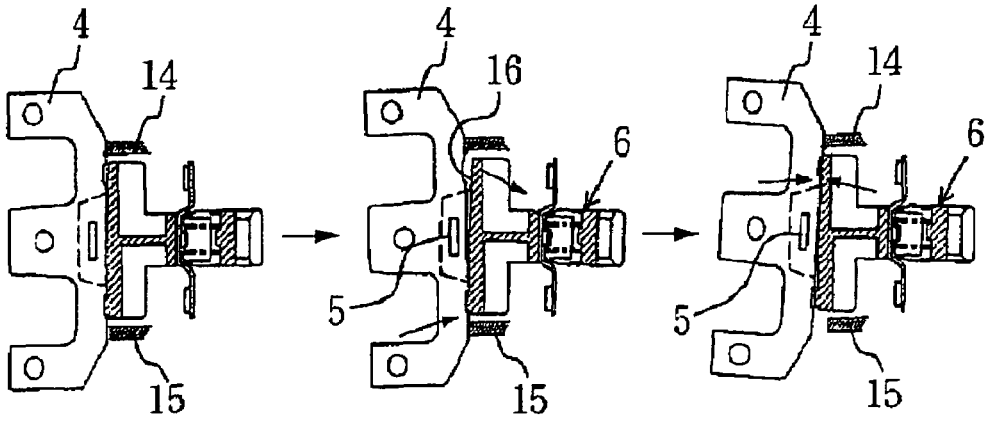
Fig. 4A Fig. 4B Fig. 4C

Fig. 7
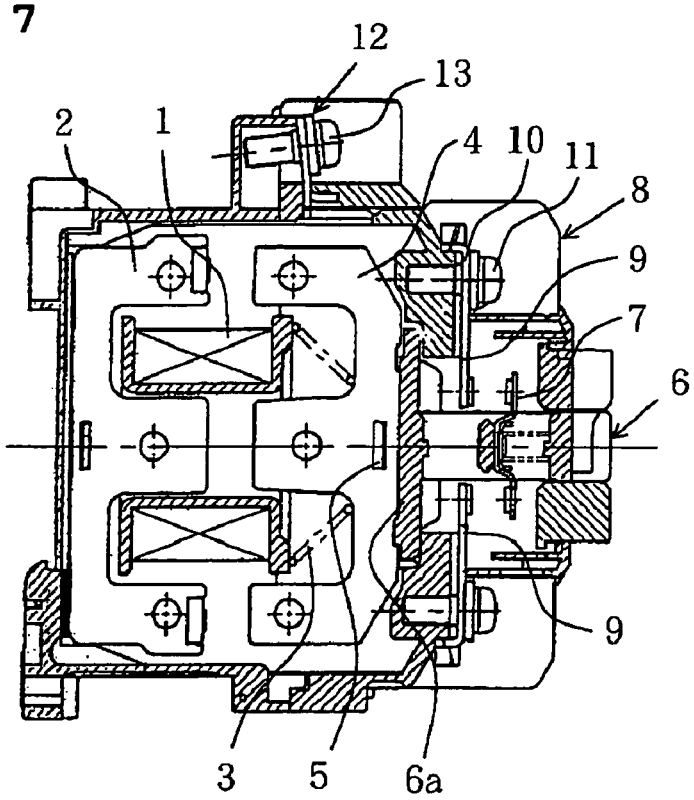
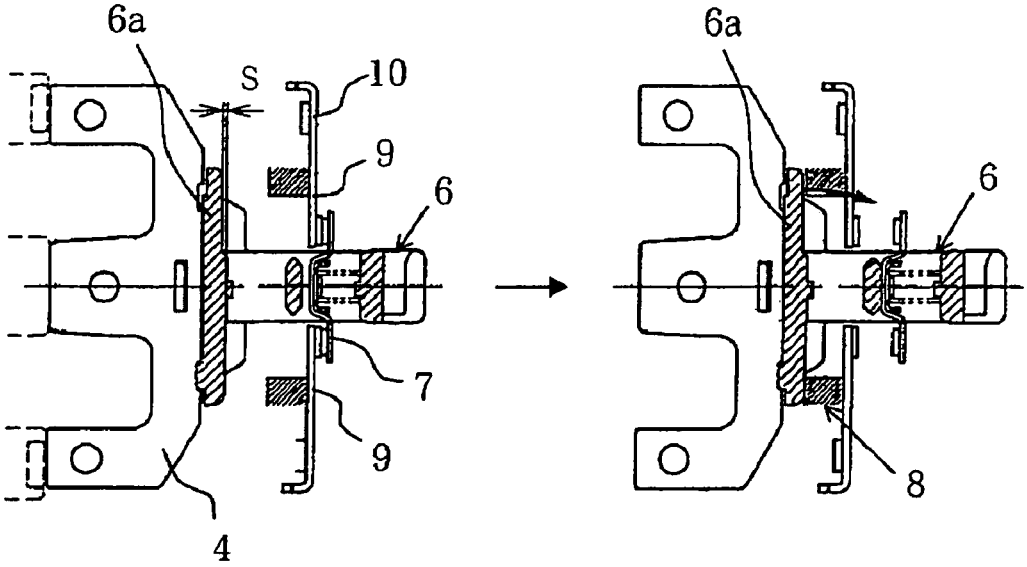
Fig. 8A
Fig. 8B

ELECTROMAGNETIC CONTACTOR

BACKGROUND OF THE INVENTION

1. Technical Field

The invention relates to an electromagnetic contactor that utilizes an electromagnet device to open or close a contact point, and more specifically, to a mechanism for preventing the bounce of a movable contact support when a movable iron core is released.

2. Prior Art

An electromagnetic contactor generally has a structure in which a movable contact support connected to a movable iron core of an electromagnet device retains a movable contact for each phase. In such a contactor, a mold frame for guiding the movable contact support in a slidable manner is fixed with a pair of front and rear fixed contacts for respective phases. In this structure, when an electromagnetic coil is excited to attract a movable iron core, the movable contact bridges the fixed contact to close the cable run, and when the electromagnetic coil is demagnetized, the released movable iron core is driven by the spring force of a return spring and the movable contact is separated from the fixed contact to open the cable run. In this case, the released movable iron core collides with the mold frame, and stops. This poses a risk in which the bounce of the movable contact support causes the once-separated movable contact to abut with the fixed contact, thus closing the cable run again.

A known electromagnetic contactor for preventing this is disclosed in Japanese Laid Open Utility Model Publication No. 64-16043, and is configured such that the base bottom face of the movable contact support abutted with the back face of a movable iron core has a step (different height) so that the movable iron core is inclined by this difference in height when the movable iron core collides with the mold frame, thereby preventing the movable contact support to bounce.

FIG. 7 is a longitudinal sectional view of an electromagnetic contactor illustrating another conventional example that is similar to the above-described one shown in Japanese Laid Open Utility Model Publication No. 64-16043. Hereinafter, the electromagnetic contactor will be newly described based on this. In FIG. 7, an electromagnet device consists of: a fixed iron core 2 having an electromagnetic coil 1; and a movable iron core 4 that is attracted toward the fixed iron core 2 by activation of the coil against the elastic force of a return spring 3. The back face of the movable iron core 4 is connected with a movable contact support 6 via a plate spring 5 and the movable contact support 6 retains a movable contact 7 having each phase. The movable contact support 6 is slidably guided by a mold frame 8 in the left-and-right direction of FIG. 7. The mold frame 8 is fixed with a pair of front and rear fixed contacts 9 for each phase.

In the "released" condition of the contactor of FIG. 7, a base section 6*a* of the movable contact support 6 abutting the back face of the movable iron core 4 faces a mold frame 8, while one end thereof (shown at the lower end portion of FIG. 7) abuts with the mold frame 8. On the other hand, the other end of the base section 6*a* (shown at the upper end portion of FIG. 7) is spaced from the mold frame 8 by a step S provided at the lower end section (See FIGS. 8A and 8B). Each fixed contact 9 is integrally formed with a respective one of the two main terminals 10 and is attached with a terminal screw 11. The upper part of the mold frame 8 of FIG. 7 is also attached with a coil terminal 12 for supplying power to the electromagnetic coil 1 and is attached with a terminal screw 13.

FIGS. 8A and 8B show how the electromagnetic contactor of FIG. 7 operates, FIG. 8A showing the "linked" condition and FIG. 8B showing the "released" condition. When the electromagnetic coil 1 (FIG. 7) is excited in FIGS. 8A and 8B, the movable iron core 4 is attracted toward the fixed iron core 2, and the movable contact 7, retained by the movable contact support 6, moves left to bridge the space between the fixed contacts [[9,]] 9 as shown in FIG. 8A, resulting in the cable run between the main terminals 10 being closed. Thereafter, when the electromagnetic coil 1 is demagnetized to release the movable iron core 4, the spring force of the return spring 3 (FIG. 7) separates the movable iron core 4 from the fixed iron core 2 tb cause the movable contact 7 to be separated from the fixed contact 9, thereby opening the cable run.

Then, the movable iron core 4 driven by the return spring 3 collides with the mold frame 8 as shown in FIG. 8(B) via the lower end section of the base section 6*a* of the movable contact support 6 so that the stop position thereof is regulated. When the movable iron core 4 is stopped, a movable section consisting of the movable iron core 4 and the movable contact support 6 is rotated clockwise due to the presence of the space between the upper end section of the base section 6*a* and the mold frame 8, and due to this rotation, the kinetic energy of the movable sections 4 and 6 is consumed as a moment of rotational inertia to reduce the impact by the collision between the movable iron core 4 and the mold frame 8, thereby preventing reclosure of the cable run due to the bounce of the movable contact support 6.

The electromagnetic contactor is generally attached to a panel as shown in FIG. 7 such that the side to which the coil terminal 12 is provided (power source side) is at the top, and the body lies in a lateral direction. The electromagnetic contactor shown in Japanese Laid Open Utility Model Publication No. 64-16043 or in FIG. 7 is manufactured with such a step arrangement, provided at the top of the movable contact support.

In this case, the movable iron core 4 in the "released" condition in FIG. 7 supported by the mold frame 8 in a cantilever manner via the movable contact support 6 is inclined in a slightly anticlockwise direction due to the weight thereof, with the lower part of the movable iron core 4 abutted with the mold frame 8 via the movable contact support 6. Due to this, the movable iron core 4 in the "released" condition always collides with the mold frame 8 at the lower side to enable the upper side step to work effectively, and the movable iron core 4 rotates around the lower side to reduce the impact. This also applies to the electromagnetic contactor shown in Japanese Laid Open Utility Model Publication No. 64-16043. The movable contact support and the guide face of the mold frame have therebetween a gap by which the above-described inclination of the movable iron core is caused.

On the other hand, when a conventional electromagnetic contactor is attached such that the coil terminal 12 is provided at the lower side (i.e., the step of the movable contact support 6 is provided at the lower side), then the above-described inclination of the movable iron core 4 deprives the movable contact support 6 of the function of the step. As a result, the rotation of the movable iron core 4 in the "released" condition is not caused, and thus the effect for reducing the impact is not obtained. To prevent this, the conventional electromagnetic contactor has been fixed in one predetermined direction so that the coil terminal 12 is provided at the upper side.

However, the recent diversification of device layouts has created a need for an arrangement in which the electromagnetic contactor is attached such that the coil terminal 12 is provided at the lower side, but this style of attachment cannot provide the buffering effect at the release, as described above. In view of the above, it is an objective of the invention to provide such an electromagnetic contactor for reducing the impact by rotating the movable iron core at the release, by which the buffering effect can be obtained regardless of the whether the coil terminal is attached at the upper or lower side.

SUMMARY OF THE INVENTION

In order to solve the above problem, the invention provides an electromagnetic contactor that includes an electromagnet device consisting of a fixed iron core having an electromagnetic coil and a movable iron core attracted to this fixed iron core by activation of the coil against the elastic force of a return spring. A movable contact support connected to the back face of the movable iron core via a plate spring retains a movable contact for each phase. A mold frame for guiding the movable contact support in a slidable manner is fixed with a pair of front and rear fixed contacts. When the excitation of the electromagnetic coil allows the movable iron core to be attracted, the movable contact bridges the fixed contact, and, when the demagnetization of the electromagnetic coil allows the movable iron core to be released, the spring force of the return spring moves the movable iron core away from the fixed iron core, the movable contact is thereby separated from the fixed contact, and the movable iron core collides with the mold frame so as to stop. The mold frame is formed with a pair of collision sections that are opposed to the back face of the movable iron core with the movable contact support therebetween, and that are provided to have different heights. An inclined plane is provided in the vicinity of the higher collision section of the base bottom face abutted with the back face of the movable iron core of the movable contact support such that the inclined plane is lowered from the point in front of the center of this base bottom face toward the end part.

In the invention, when the electromagnetic contactor is attached with the higher collision section provided at the lower side, then the movable iron core in the "released" condition is rotated around this collision section as in the conventional case. On the other hand, when the electromagnetic contactor is attached with the lower collision section provided at the lower side, then the movable contact support attracted toward the movable iron core by the plate spring is allowed to collide, at the bounce of the movable contact support, with the back face of the movable iron core via the inclined plane, thereby canceling the inertia by the bounce to reduce the impact. As a result, a buffering effect can be provided to the collision of the movable iron core even when the electromagnetic contactor is attached with the regular upper and lower sides reversed.

BRIEF DESCRIPTION OF THE DRAWINGS

FIGS. 2A and 2B show a movable section in FIG. 1, wherein FIG. 2A is a side view and FIG. 2B is a bottom view.

FIG. 3 is a side view of the main part for explaining the operation of the movable section when the electromagnetic contactor of FIG. 1 is attached with the coil terminal provided at the lower side.

FIG. 4 is a side view of the main part for explaining the operation of the movable section when the electromagnetic contactor of FIG. 1 is attached with the coil terminal provided at the upper side.

FIG. 7 is a longitudinal sectional view of a conventional example of an electromagnetic contactor.

FIGS. 8A and 8B are side views of the main part for explaining the operation of the electromagnetic contactor of FIG. 7.

DETAILED DESCRIPTION OF THE PREFERRED EMBODIMENT

Figure 1:
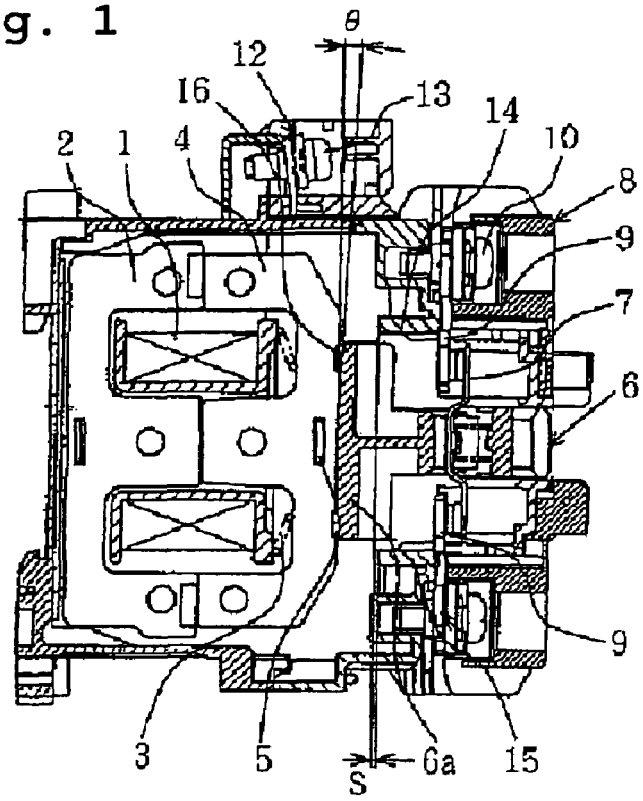
FIG. 1 is a longitudinal sectional view of an electromagnetic contactor illustrating an embodiment of the invention.
Figure 2A:
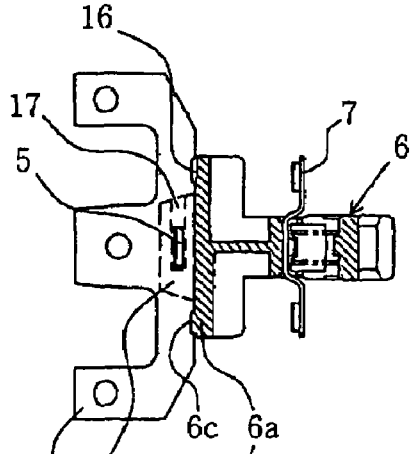
Figure 2B:
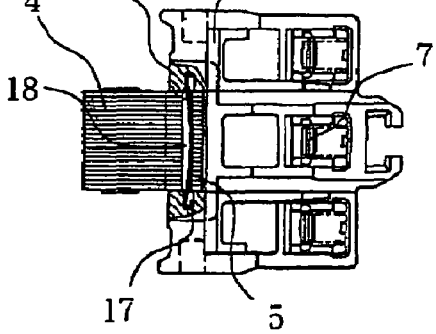

FIG. 1 is a longitudinal sectional view of an electromagnetic contactor in the "linked" condition showing an embodiment of the invention. FIG. 2A is a side view illustrating a movable part (movable iron core and movable contact support) of the electromagnetic contactor of FIG. 1. FIG. 2B is a bottom view thereof. The components corresponding to those of the conventional example are shown with the same reference numerals. In FIG. 1, the mold frame 8 is formed with a pair of collision sections 14 and 15 that are opposed to the back face of the movable iron core 4, with the movable contact support 6 therebetween. These collision sections 14 and 15 are provided to have different heights so that the collision section 14 is higher than the collision section 15 by the step S. The collision sections 14 and 15 have a plate-like shape and the width perpendicular to the page of FIG. 1 is substantially the same as the thickness of the core lamination layer of the movable iron core 4 shown in FIG. 2B.

On the other hand, the movable contact support 6 has a base bottom face 6*a* abutted with the back face of the movable iron core 4. The base bottom face 6*a* of the movable contact support 6 has an inclined plane 16 having an inclination O. This inclined plane 16 is provided in the vicinity of the higher collision section 14 of the base bottom face of the movable contact support 6, such that the inclined plane 16 is below the point in front of the center of the base bottom face (see FIG. 3, and in FIGS. 1 and 2, the upper side of the center of the movable contact support 6) toward the end part. As shown in FIGS. 2A and 2B, the movable contact support 6 has a pair of left and right arm sections 6*b* extending from the base section 6*a* to sandwich both sides of the movable iron core 4. The pair of (left and right) arm sections 6*b* include a groove 17 having an opening at the upper side of FIG. 2A. The arm section 6*b* is fitted, via this groove 17, into both sides of the arch-like plate spring 5 penetrating the window hole 18 of the movable iron core 4 from the lower side of FIG. 2A, thus being connected to the movable iron core 4 by being attached to the back face thereof. This movable contact support 6 is prevented from being disengaged by engaging the convex section 6*c* with the concave section of the back face of the movable iron core 4. Except for the above point, the electromagnetic contactor has substantially the same structure as that of the conventional example of FIG. 7.

FIG. 3 is a side view of the movable part with the electromagnetic contactor of FIG. 1 attached to the coil terminal 12 provided at the lower side. In this attachment condition, the higher collision section 14 is provided at the lower side while the lower collision section 15 is provided at the upper side. In the "released" condition, the back face of the movable iron core 4 collides with the collision section 14 first as shown in the drawing, and the movable parts 4 and 6 are rotated clockwise around the collision section 14, as shown by the arrow, to reduce the impact. This effect is substantially the same as that provided by the conventional example.

Figure 5:
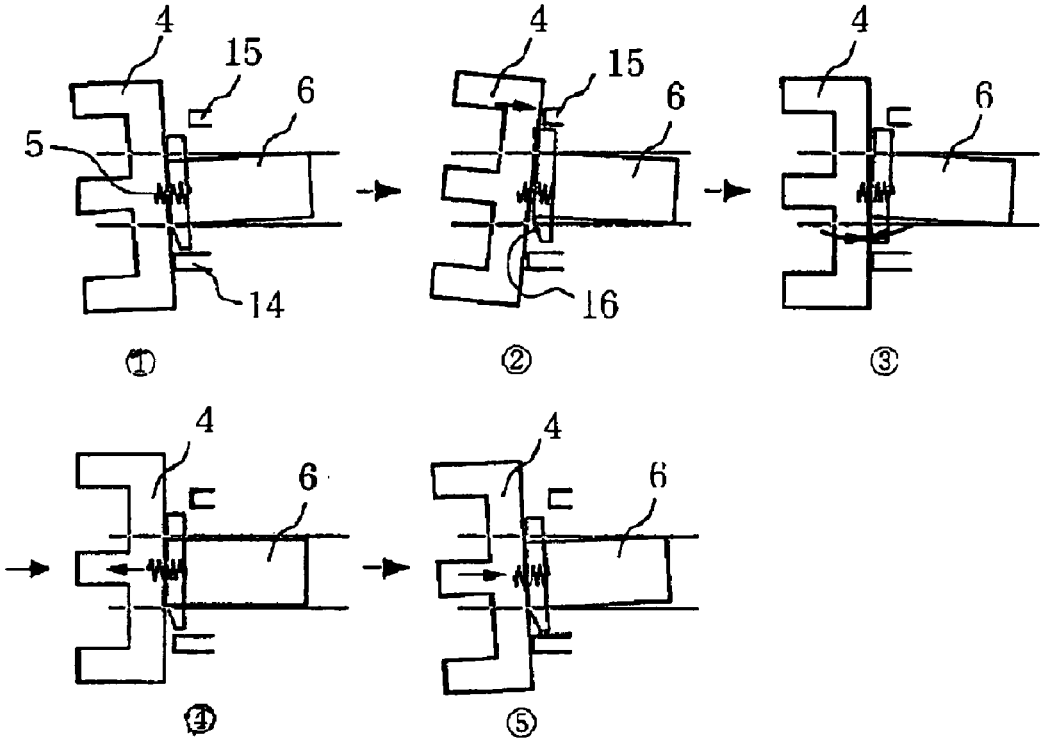
FIG. 5 illustrates the operation of the main part as shown in FIG. 3 in further detail.

This buffering effect will be described in further detail with reference to the order of operation ① to ⑤ schematically shown in FIG. 5. Specifically, when the movable iron core 4 is released, the movable iron core 4 collides with the higher collision section 14 first, as shown by ①, and then the movable sections 4 and 6 are rotated clockwise around the collision section 14, and the movable iron core 4 also collides with the lower collision section 15, as shown by ②. Then, the movable contact support 6 is rotated anticlockwise while deforming the plate spring 5.

During this action, most of the kinetic energy is absorbed as a moment of rotation. Thereafter, as shown by ③, the movable iron core 4 and the movable contact support 6 are attracted to each other by the restoring force of the plate spring 5 and are returned in anticlockwise and clockwise directions, respectively, thus allowing the back face of the movable iron core 4 to collide with the inclined plane 16 of the movable contact support 6. As a result, the remainder of the kinetic energy is absorbed. Thereafter, the back face of the movable iron core 4 is abutted with the base end face of the movable contact support 6 as shown by ④, and then the movable iron core 4 is abutted with the higher collision section 14 to stop as shown by ⑤.

FIGS. 4A to 4C are side views of the movable part for explaining the operation when the electromagnetic contactor is attached with the coil terminal 12 provided at the upper side (see FIG. 1). In this attachment condition, the higher collision section 14 is provided at the upper side while the lower collision section 15 is provided at the lower side. When the movable iron core 4 is released from the "linked" condition of FIG. 1, the movable iron core 4 collides with the higher collision section 14 at the upper side first, as shown in FIG. 4A. Then, as shown in FIG. 4B, the movable iron core 4 is rotated anticlockwise, as shown by the arrow, to collide with the lower collision section 15. Then, the movable contact support 6 is rotated clockwise, as shown by the arrow, to deform the plate spring 5. Thereafter, as shown in FIG. 4C the movable iron core 4 and the movable contact support 6 are attracted to each other by the restoring force of the deformed plate spring 5, and the back face of the movable iron core 4 collides with the inclined plane 16 of the movable contact support 6, thereby absorbing the kinetic energy.

Figure 6:
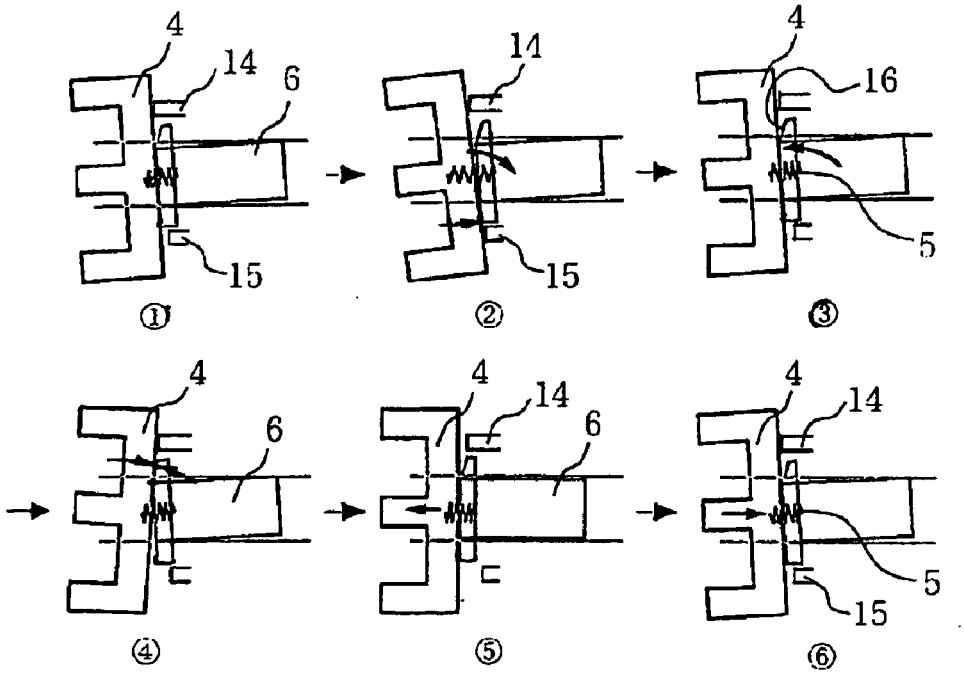
FIG. 6 illustrates the operation of the main part as shown in FIG. 4 in further detail.

This buffering effect will be described in further detail with reference to the order of operation ① to ⑥ schematically shown in FIG. 6. When the movable iron core 4 is released, the movable iron core 4 collides with the higher collision section 14 first, as shown by ①, and then the movable sections 4 and 6 are rotated anticlockwise around the collision section 14, and the movable iron core 4 also collides with the lower collision section 15, as shown by ②. At the same time, the movable contact support 6 is rotated clockwise by the inertia around the lower end section to deform the plate spring 5 to the maximum. Next, the restoration of the plate spring 5 allows the movable contact support 6 to be returned to the movable iron core 4, as shown by ③, and the base bottom face collides with the back face of the movable iron core 4 and also collides with the inclined plane 16, as shown by ④. As a result, the kinetic energy is absorbed. Next, the recoil allows, as shown by ⑤, the base bottom face of the movable contact support 6 to be abutted with the back face of the movable iron core 4 again, and the movable iron core 4 is once separated from the collision section 14. Thereafter, the movable iron core 4 is abutted with the collision section 14 again and stops, as shown by ⑥.

INDUSTRIAL APPLICABILITY

As described above, according to the invention, the mold frame is formed with a pair of higher and lower collision sections that are opposed to the back face of the movable iron core with the movable contact support therebetween. On the other hand, the base bottom face abutted with the back face of the movable iron core of the movable contact support has an inclined plane. As a result, the impact caused by the collision between the movable section and the mold frame at the release can be reduced regardless of the method by which the electromagnetic contactor is attached with the coil terminal provided at the upper or the lower side.

The invention claimed is:

1. An electromagnetic contactor, comprising:

a return spring;

an electromagnet device that includes a fixed iron core having an electromagnetic coil and a movable iron core attracted to the fixed iron core against the elastic force of the return spring;

a plate spring;

a plurality of movable contacts, one for each of a plurality of phases;

a movable contact support retaining the movable contacts, the movable contacts being connected to a back face of the movable iron core via the plate spring, a mold frame for guiding the movable contact support in a slidable manner, and a pair of front and rear fixed contacts fixed to said mold frame;

wherein, when excitation of the electromagnetic coil allows the movable iron core to be attracted to the fixed core, the movable contacts bridge the fixed contacts, and, when demagnetization of the electromagnetic coil allows the movable iron core to be released, the spring force of the return spring moves the movable iron core, the movable contacts are separated from the fixed contacts, and the movable iron core collides with the mold frame to stop;

wherein the mold frame includes first and second collision sections opposed to the back face of the movable iron core with the movable contact support therebetween, the collision sections having different heights so that an end face of the first collision section is disposed closer to said fixed iron core than an end face of the second collision section; and wherein the movable contact support has a base bottom face that abuts the back face of the movable iron core, the base bottom face having an inclined plane in the vicinity of the higher collision section of the mold frame, such that the inclined plane is below a point in front of a center of the base bottom face.

* * * * *